United States Patent [19]

Persson

[11] 4,240,576

[45] Dec. 23, 1980

[54] DISTRIBUTION PACKAGE

[75] Inventor: Karl R. Persson, Halmstad, Sweden

[73] Assignee: Duni Bila AB, Sweden

[21] Appl. No.: 37,412

[22] Filed: May 9, 1979

[30] Foreign Application Priority Data

May 10, 1978 [SE] Sweden ..... 7805344

[51] Int. Cl.[3] ..... B65D 5/24; B65D 5/66

[52] U.S. Cl. ..... 229/36; 229/45 R; 229/52 B

[58] Field of Search ..... 229/33, 36, 45

[56] References Cited

U.S. PATENT DOCUMENTS

| | | | |
|---|---|---|---|
| 2,311,403 | 2/1943 | Lighter | 229/36 X |
| 2,642,218 | 6/1953 | Platt | 229/36 X |
| 2,839,236 | 6/1958 | Dumming | 229/45 |
| 2,844,295 | 7/1958 | Williams | 229/33 |
| 3,015,430 | 1/1962 | Bauer | 229/45 |
| 3,166,235 | 1/1965 | Schroeder | 229/52 B |
| 3,404,829 | 10/1968 | Stone | 229/36 X |
| 3,581,976 | 6/1971 | Burgess | 229/36 |
| 3,680,766 | 8/1972 | Collura et al. | 229/45 X |
| 3,840,172 | 10/1974 | Zimmerman | 229/36 |

*Primary Examiner*—Davis T. Moorhead

*Attorney, Agent, or Firm*—Ostrolenk, Faber, Gerb & Soffen

[57] ABSTRACT

The present invention relates to a distribution or marketing package, formed from a single carton blank and comprising a bottom tray with a lid hingedly attached to one of its side walls and closable on the tray, said lid in its closed position being connectable with a side wall of the tray opposing said side wall, by means of a locking device at the free end of the lid.

12 Claims, 9 Drawing Figures

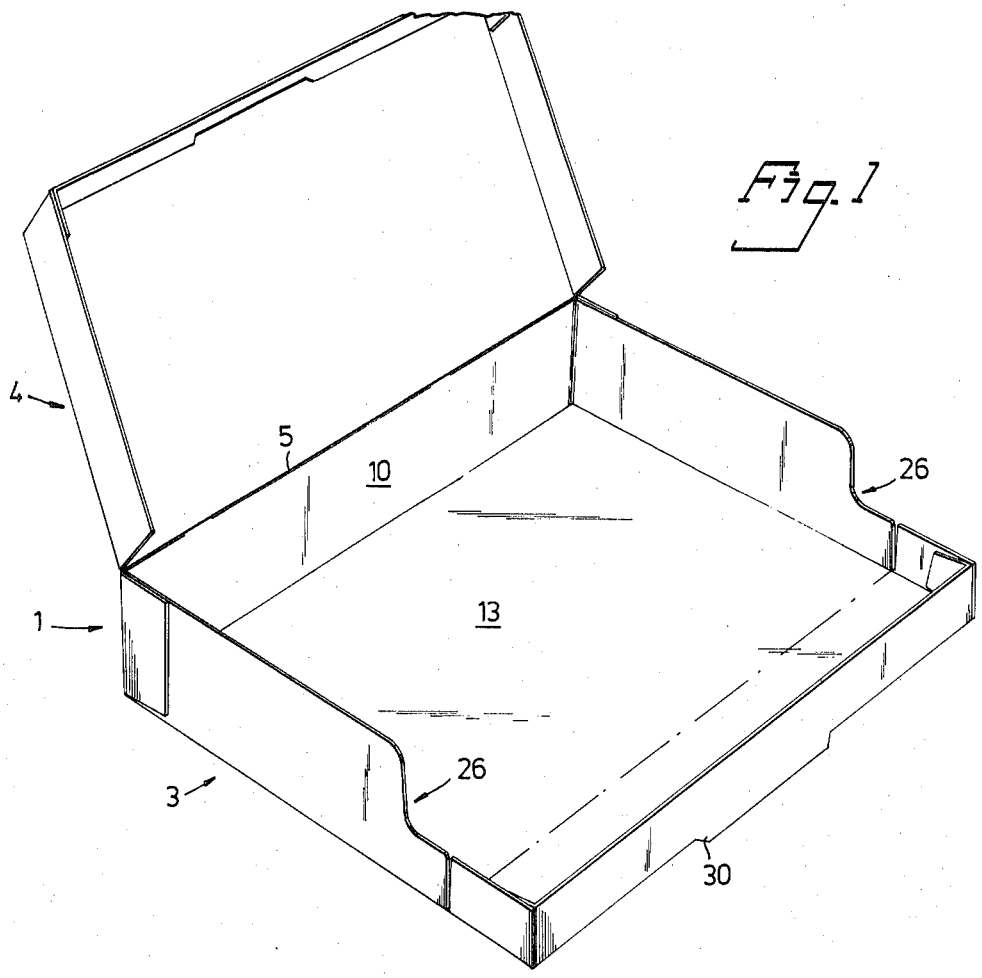
Fig. 1
Fig. 2
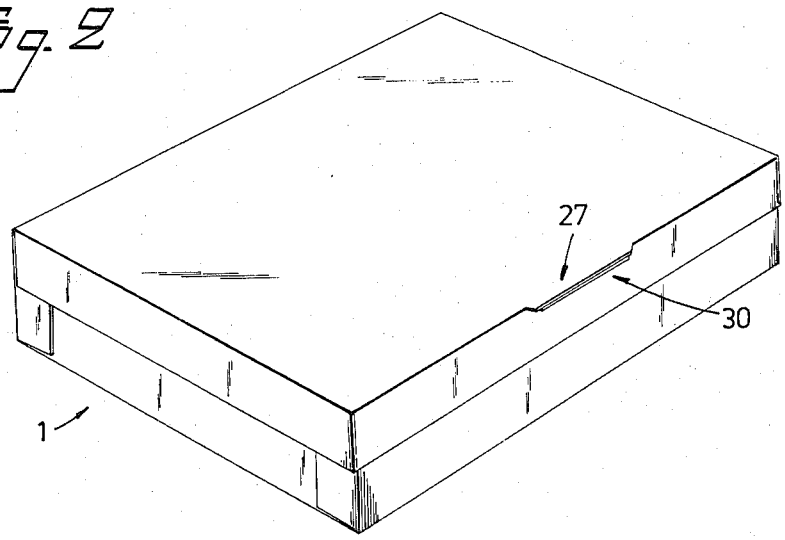

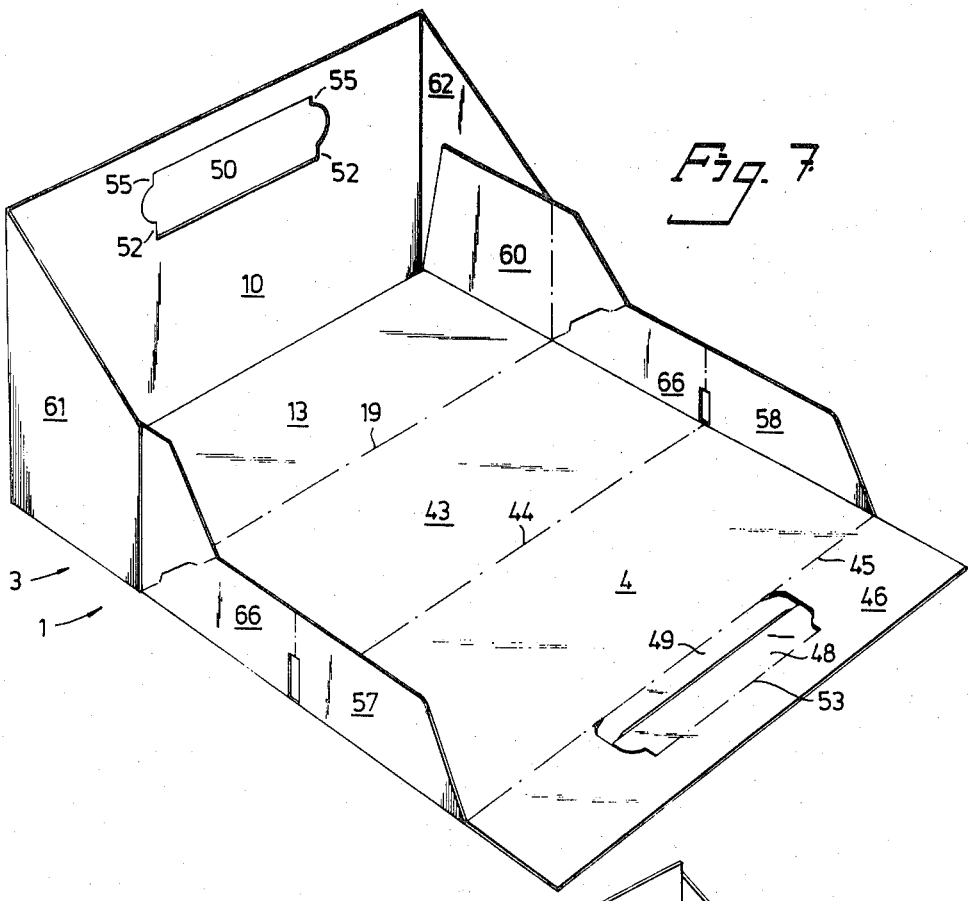
Fig. 7
Fig. 8
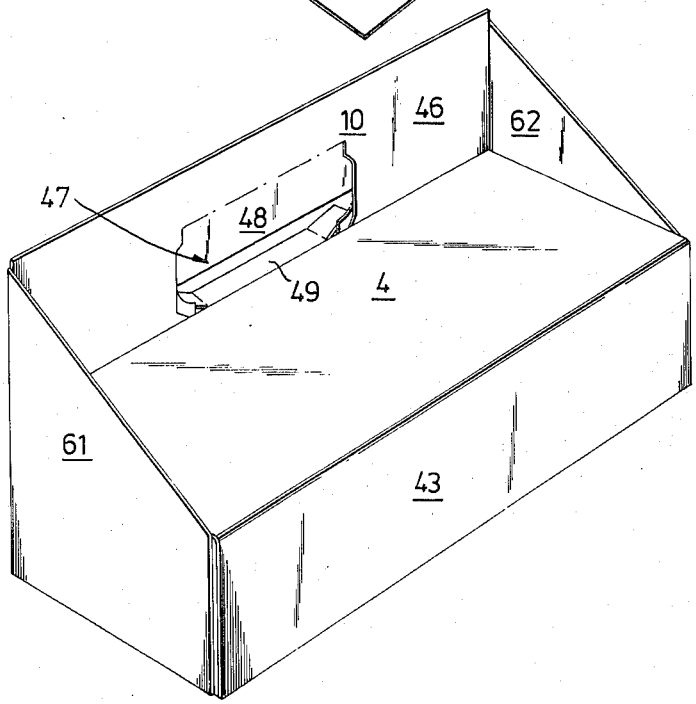

DISTRIBUTION PACKAGE

BACKGROUND OF THE INVENTION

The object of the present invention is to provide a package which can be used for both transport and serving of different goods or products, which can be easily opened at the place where its contents are to be consumed and by being opened is automatically given a tray or serving surface which is larger than the original bottom area of the package in its distribution condition. One field of use particularly suited to the inventive package, precisely because of these properties, is for serving ready-prepared food on aeroplanes. It is thus important that the package requires the least possible space on the occasions of storing, serving and use while it optimally meets the purpose on each of these occasions. Since the side walls of the package are sloping, it is especially suited to automatic erection, and erected packages can be stacked one inside the other so that a compact distribution volume is obtained as far as the filling location. By being in an erected condition, the packages are easy to fill and close, and because of their construction they are so stable that a plurality of filled containers can be stacked one on top of the other to facilitate serving to passengers. Finally, the user not only automatically obtains a tray area larger than the bottom area of the package before it was opened, but also better accessibility of the contents without needing to remove them from the package.

This is achieved by the present invention, directed to providing a package of the kind mentioned in the introduction, and which is substantially distinguished in that the front side wall of the tray is forwardly or outwardly lowerable to a position in which it is in the same plane as the bottom of the tray to provide not only an increased bottom area but also better accessibility of the contents of the package.

Figure 3:
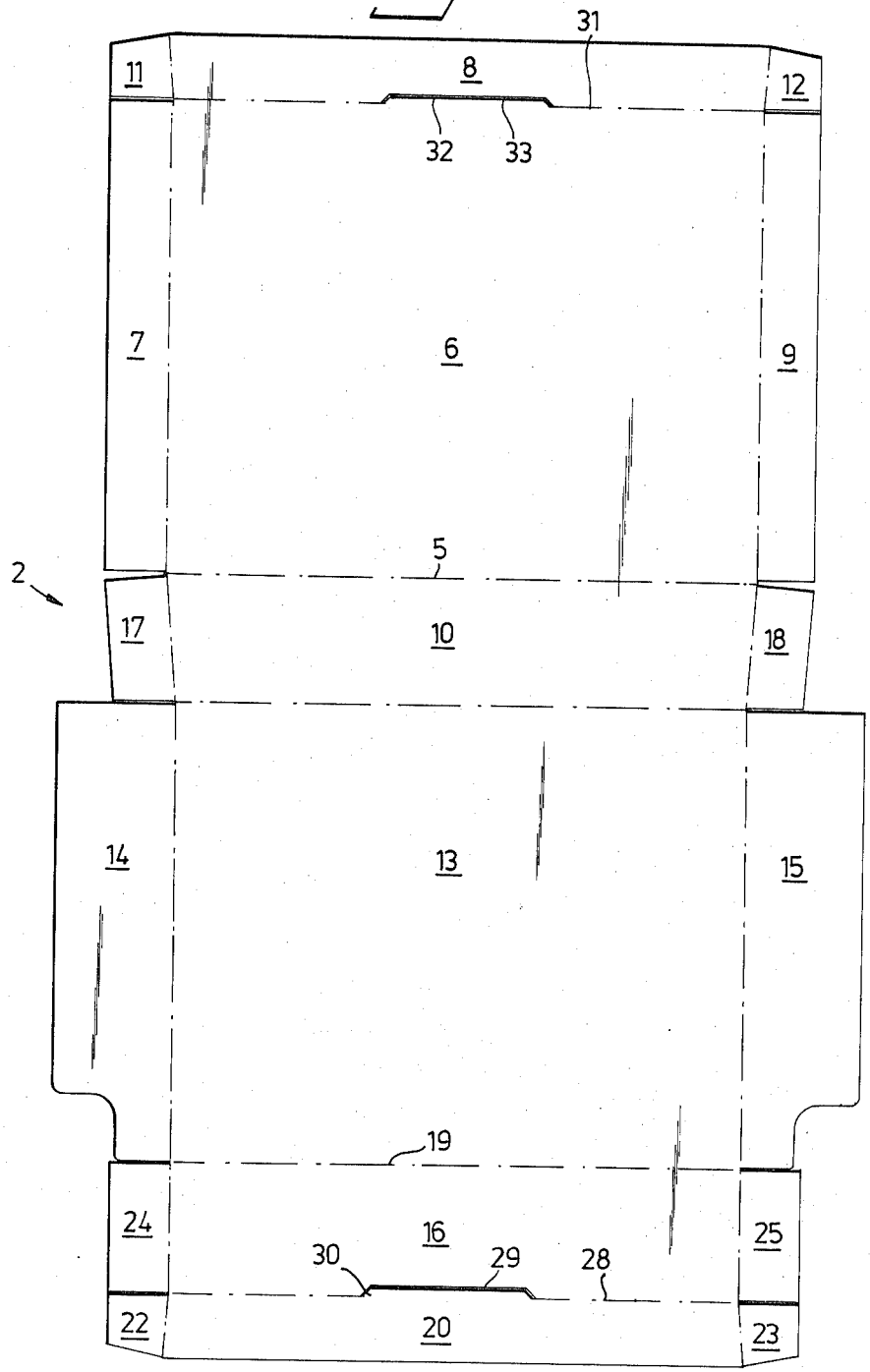
Figure 4:
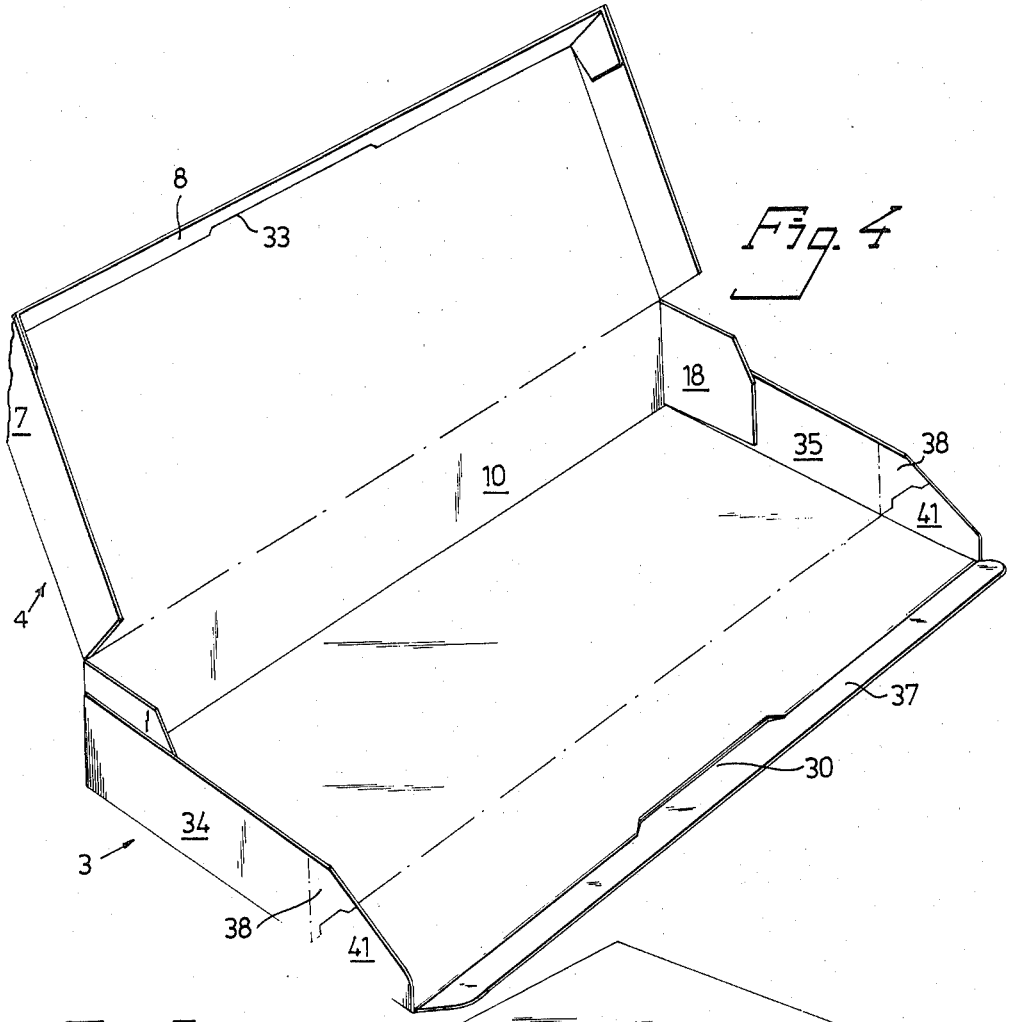
Figure 5:
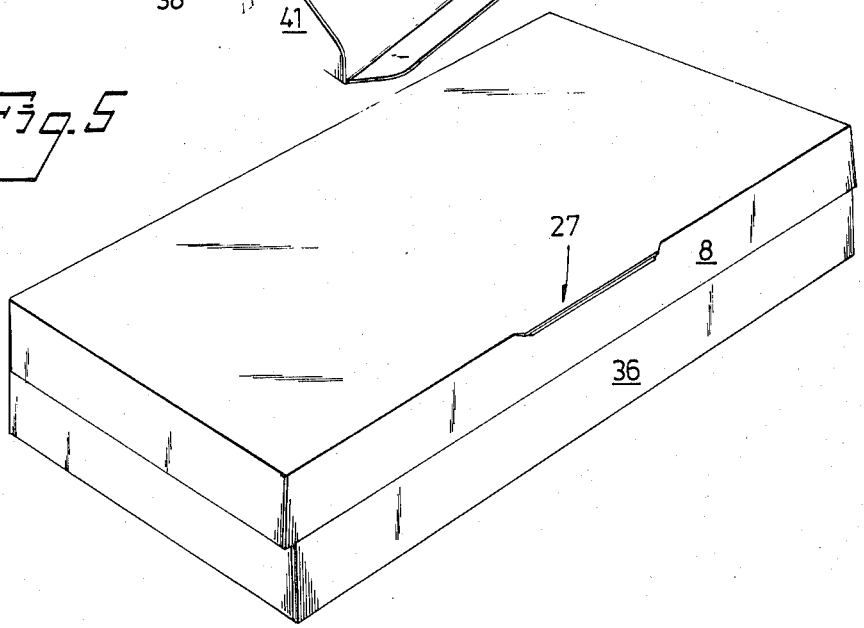
Figure 6:
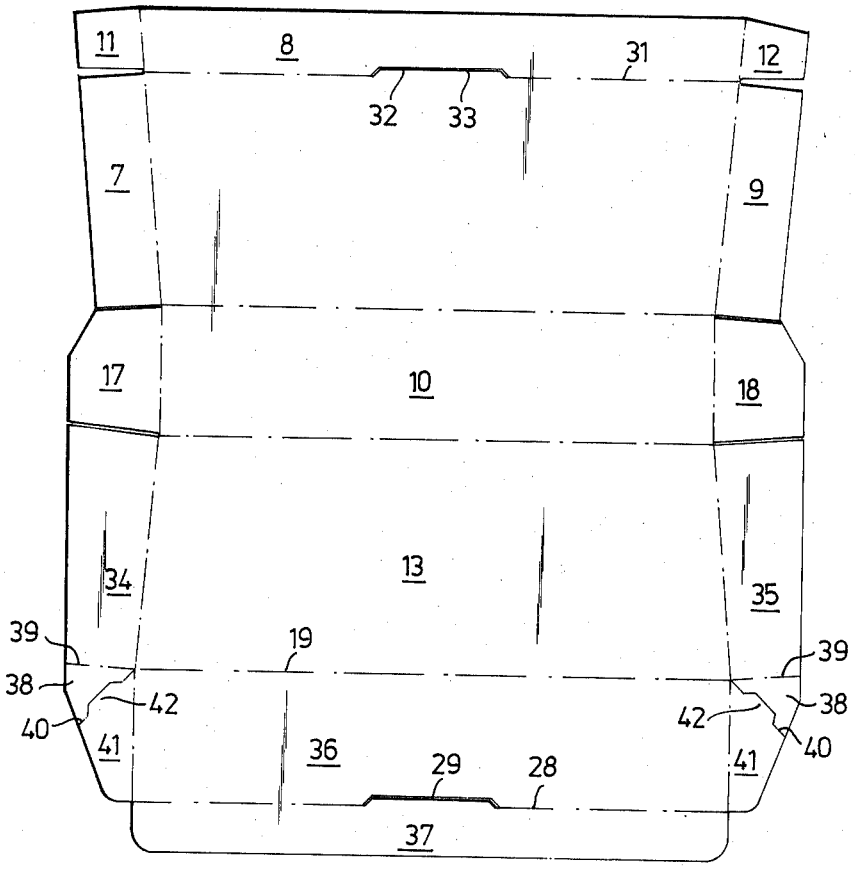
Figure 9:
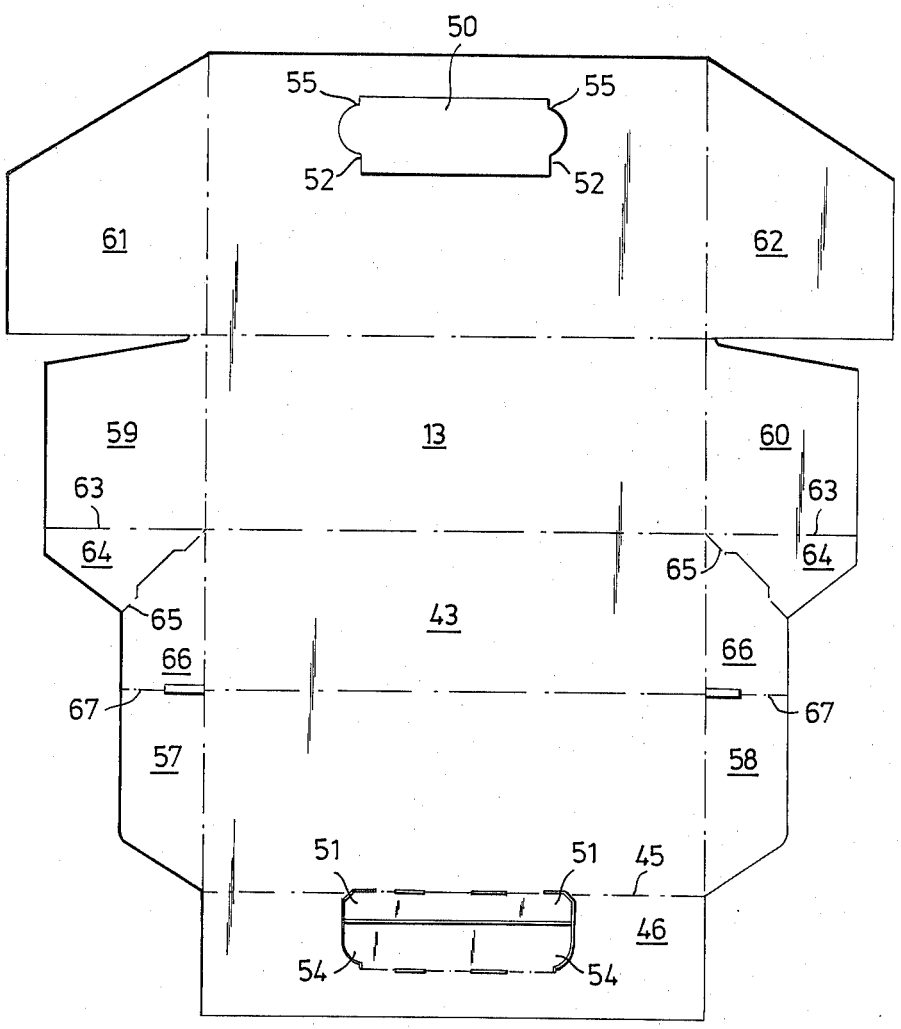

The invention will now be described in detail while referring to the accompanying drawings, of which FIG. 1 is a schematic perspective view of an embodiment of a package in accordance with the invention, shown in its erected condition and in the attitude it has when opened, FIG. 2 illustrates the same package in a closed condition, FIG. 3 illustrates a blank for the package shown in FIGS. 1 and 2, FIG. 4 is a schematic perspective view of a second embodiment of the inventive package, in its erected and opened condition, FIG. 5 illustrates the package of FIG. 4 in its closed condition, FIG. 6 illustrates a blank for the package shown in FIGS. 4 and 5, FIG. 7 is a schematic perspective view of a third embodiment of the inventive package, shown in the same way as the other two variations in its erected and opened condition, FIG. 8 illustrates the package of FIG. 7 in its closed condition, and FIG. 9 illustrates a blank for the package of FIGS. 7 and 8.

The package 1 illustrated in FIGS. 1 and 2 is erected from a blank 2 illustrated in FIG. 3. By means of score lines and slits, this blank 2 is divided into areas for forming a bottom tray 3 and a lid 4 also formed as a tray, the tray and lid being hingedly connected to each other along a score line 5, as is apparent from FIGS. 1 and 2. The lid 4 consists of a covering portion 6 with opposing side flaps 7 and 9 which can be folded down, and a flap 8 along its front edge. The covering part 6 is hingedly connected with the upper edge of the back side wall 10 of the tray 3 by means of the score line 5. The edge flap 8 is extended at its ends by end flaps 11, 12.

The tray 3 has a bottom 13 extended at its sides by erectable side walls 14, 10, 15, 16, of which the wall 10 constitutes the back side wall and the wall 16 constitutes the front side wall. At its ends, the back side wall 10 is extended by the end flaps 17, 18. The front side wall 16 is hingedly connected to the bottom of the tray 3 along a score line 19 and at its free end edge is extended by an edge flap 20 and connected to the side wall 16 along a score line 28. The ends of the edge flap 20 are extended by end flaps 22, 23 and the side wall 16 is similarly extended by side flaps 24, 25.

To erect the blank in FIG. 3 into the package 1 illustrated in FIGS. 1 and 2, the side walls 14, 10, 15 are folded upwards and fixed in position with the help of the end flaps 17, 18, which are attached to the adjacent side walls 14, 15, e.g. by gluing. The side flaps 24, 25 and the edge flap 20 are folded upwards in a similar way and fixed in position with the aid of the end flaps 22, 23. The side flaps 7, 9 and edge flap 8 of the lid 4 are fixed in position by the end flaps 11 and 12. The front side wall 16 is erectable against the side walls 14, 15 along the score line 19, and its edge flap 20 with associated side flaps 24, 25 are accommodated in its erected position by notches 26 in the front, upper corners of the side walls 14, 15 of the tray 3. In the erected position of the front side wall 16, its side flaps 24, 25 are arranged to lie outside of the side walls 14, 15 of the tray 3. To enable stacking a plurality of packages inside each other, the side walls 14, 15 and the side flaps 7, 9 and 24, 25 slope outwards. To obtain the necessary slope of the other two opposing side flaps, it is only necessary that the lid 4 and the forward side wall 16 are bent backwards about the score lines 5 and 19, respectively.

To close the package 1, it is provided with a locking means 27 formed in the front side wall 16 and lid 4 by having the score line 28 connecting the edge flap 20 with the forward side wall 16 interrupted by a slit 29, the ends of which extend in onto the side wall 16 to form a locking tongue 30 intended to form a locking projection in the plane of the edge flap 20, and also by the score line 31 between the flap 8 and the covering portion 6 of the lid being interrupted by a slit 32, at its ends joining onto the score line 31 and extending over onto the edge flap 8 to form a locking slit or locking opening 33, in which the outwardly directed locking projection or tongue 30 on the front side wall edge flap 20 is intended to engage when the lid 4 is in its completely closed condition. Then the package 1 is to be opened, it is only necessary to press in the upper, central portion of the front side wall 16 somewhat, whereby the locking tongue 30 is released from the locking opening 33.

The embodiment of the package and the blank forming it, illustrated in FIGS. 4–6, differs from the one according to FIGS. 1–3, already described, mainly in that the side walls 34, 35 of the bottom tray 3 are cut obliquely forwards from the back side wall 10, that the edge flap 37 of the front side wall 36 is free and that the side walls 34, 35 of the bottom tray 3 are each extended via score lines 39 by an end flap 38, at its end edge merging via score lines 40 into a communicating area 41 between the end flap 38 and the front side wall 36. The score lines 40 can suitably be provided with cuts 42 made with a special knife so that during use, after the package has been opened, it is possible to lock the end flaps 38 and the communicating area 41 in the plane of the side walls 34, 35 so that the forward side wall 36 is pressed down and retained in the same plane as the bottom 13 of the tray 3.

In the embodiment illustrated in FIGS. 7–9, the front side wall 43 is extended via a score line 44 to form the lid 4 of the package, the free end of the lid being extended by an edge flap 46 hingedly connected to said lid 4 along a score line 45. When the lid is closed, this edge flap 46 engages flat against the back side wall 10 of the tray 3 and is fixed to it by a locking means 47 consisting of an upper 48 and a lower 49 locking tongue stamped out in the edge flap 46 of the lid 4, and a locking opening 50 stamped out to approximately the shape of tongues 48, 49 in the area for these tongues in the back side wall 10 of the tray 3. The lower tongue 49 is hingedly connected to the lid 4 along the score line 45, and for closing the package it is arranged to be folded in through the lower portion of the opening 50, and with the outer portions 51 of the locking tongue 49 unattached at the score line 45 to snap over and past the edge portions 52 in the locking opening 50 coacting with portions 52. The upper locking tongue 48 is furthermore hingedly connected by means of a score line 53 parallel to the score line 45, and intended for folding in between the upper portion of the opening 50, and with its outer portions 54 of the locking tongue 48 snapping past edge portions 55 coacting therewith and pertaining to the upper portion of the locking opening 50, for fixing the edge flaps 46 to the back side wall 10.

The package illustrated in FIGS. 7 and 8 is erected from a blank 56 shown in FIG. 9. By means of score lines and slits, this blank 56 is divided into areas in approximately the same way as the embodiments already described, to form a bottom tray 3 and a lid 4, hingedly connected to each other along the score line 44. Further to the edge flap 46, the lid 4 also has two opposing edge flaps 57 and 58, foldable inwards along its edges. The bottom 13 of the tray 3 is extended along its edges with two other opposing side walls 59 and 60, foldable upwards, apart from the back 10 and front side wall 43. At its ends, the back side wall 10 is extended by end flaps 61 and 62. The side walls 59, 60 of the bottom tray 3 are each extended by an end flap 64 via a score line 63, the end edge of the end flap 64 merging into a communication area 66 via score lines 65, said area also forming the side walls of the front side wall. The communication areas 66 merge into the side walls 57, 58 of the lid 4 via score lines 67.

To erect the package illustrated in FIGS. 7 and 8, the side walls 10, 59, 60 of the blank illustraded in FIG. 9 are turned upwards and fixed in their upright position by means of the end flaps 61, 62 which are attached, e.g. by gluing, to the adjacent side walls 59, 60. When the package is closed, the edge flaps 57, 58 are turned inwardly towards the inside of the lid 4 while the communication areas or side walls 66 are turned inwardly towards the inside of the front side wall 43, and after the front side wall 43 has reached its erected position against the side walls 59, 60 of the bottom tray 3, the lid 4 is closed down over the tray and is fixed by means of the locking device 47 at the back side wall 10.

I claim:

1. A distribution or marketing package (1), formed by a single carton blank (2) and comprising a bottom tray (3) having a lid (4) hingedly connected to one of the sides walls (10, 43) of the tray (3) and closable thereto, which can be coupled to a front side wall opposing said side wall of said tray (3) preferably by means of a locking means (27, 47) at the free end or edge of the lid (4) in its closed position; said front side wall (16, 36, 43) of the tray being foldable in a direction outwards or forwards to a position in which characterized in that the front side wall (16) is extended by an edge flap (20) constituting substantially a perpendicular relationship to the inside of the front side wall (16) and is fixed in this position by means of side flaps (24, 25) folded inwards from the side edges of the side wall (16) to ensure the edge flap (20) to lie flat against the inside of the lid (4) in the completely closed position of the latter making it possible to stack a plurality of filled containers one on top of the other and in the open position of the lid (4) together with the other walls at the same time to constitute a continuous border around the bottom tray (3) preventing the contents sliding out from the package after folding down the front side wall (16) to the same plane as the bottom (13) of the tray (3).

2. A package as claimed in claim 1, characterized in that the front side wall (16, 36, 43) is hingedly connected to the bottom (13) of the tray (3) along a score line (19) extending along the whole length of the tray (3).

3. A package as claimed in claim 2 or 3, characterized in that the forward side wall (16, 36) is extended by an edge flap (20, 37) intended to lie flat against the inside of the lid (4) in the completely closed position of the latter, said edge flap (20, 37) being connected to the side wall (16, 36) along a score line (28) which is interrupted by a slit (29) at least in one zone, the ends of the slit joining the score line (28) and extending in on the side wall (16, 36) to form a locking tongue (30) intended to form a locking projection directed outwardly in the plane of the edge flap.

4. A package as claimed in any one of the preceding claims, characterized in that the lid (4) at its free end is similarly extended by an edge flap (8) which is folded along a score line (31) and fixed in this position by end flaps (11, 12) projecting from the end portions of the edge flap (8), and that the score line (31) is interrupted by a slit (32) in at least one zone, the ends of the slit joining the score line (31) and extending in on the edge flap (8) to form a locking slit or locking opening (33) in which the outwardly directed locking projection (30) on the edge flap (20, 37) of the forward side wall (16, 36) is intended to engage when the lid (4) is in its completely closed position.

5. A package as claimed in any one of the preceding claims, characterized in that the edge flap (20) of the forward side wall (16) is, similarly to the edge flap (8) of the lid (4), fixed in a substantially perpendicular relationship to the inside of the front side wall (16) by means of end flaps (22, 23) projecting from the ends of the edge flap (20), said end flaps (22, 23) being attached to side flaps (24, 25) folded inwards from the side edges of the side wall (16).

6. A package as claimed in any one of the preceding claims, characterized in that the side walls (14, 15) of the bottom tray (3), contiguous to the front side wall (16), have notches (26) at their upper corner portions.

7. A package as claimed in any one of the preceding claims, characterized in that the side walls (34, 35) of the bottom tray (3), which in a closed position are intended to be contiguous to the front side wall (36), are each extended by an end flap (38) at its end edge merging into a communication area (41) between the end flap (38) and the front side wall (36).

8. A distribution or marketing package (1), formed by a single carton blank (2) and comprising a bottom tray (3) having a lid (4) hingedly connected to one of the side walls (10, 43) of the tray (3) and closable thereto, which can be coupled to a side wall opposing said side wall of said tray (3) by means of a locking means (27, 47) at the free end or edge of the lid (4) in its closed position; characterized in that the front side wall (16, 36, 43) of the tray can be folded in a direction outwards or forwards to a position in which it is in the same plane as the bottom (13) of the tray (3) to provide an increased bottom area as well as better accessibility of the contents of the package, the forward side wall (43) being extended from its upper score line (44) to form the lid (4) of the package, said lid being extended at its free end by an edge flap (46) hingedly connected to the lid (4), said flap being intended to lie flat against the back side wall (10) and being fixed in this position by the locking means (47) in the closed condition of the lid.

9. A package as claimed in claim 8, characterized in that the end flap (46) of the lid (4) is substantially perpendicular to the upper side of the lid (4) when the lid is in its closed position and the back side wall (10) of the tray (3) has a height corresponding to the sum of the heights of the front side wall (43) and the edge flap (46).

10. A package as claimed in any one of claims 8 or 9, characterized in that the locking means (47) consists of an upper (48) and a lower (49) locking tongue stamped out of the edge flap (46) of the lid (4) and a locking opening (50) stamped out of the area for these tongues (48, 49) in the back wall (10) of the tray (3), the lower locking tongue (49) being hingedly connected to the lid (4) along a score line (45) connecting the edge flap (46) to the lid (4) and being disposed for folding in through the lower portion of the opening (50) and with the outer portions (51) of the locking tongue (49), unattached at the score line (45), to snap over edge portions (52) in the locking opening (50) coacting therewith, and that the upper locking tongue (48) is hingedly connected along a score line (53) parallel to the first score line (45) in the edge flap (46) of the lid (4) and arranged for folding in through the upper of the opening (50) and with its outer portions (54) of the locking tongue (48) snapping past edge portions (55) of the upper portion of the locking opening (50) coacting therewith for fixing the edge flap (46) to the back side wall (10).

11. A distribution or marketing package (1) formed by a single carton blank (2) and comprising a bottom tray (3) having a lid (4) hingedly connected to one of the side walls (10) of the tray (3) and closable thereto, which is lockable in its closed position preferably by means of a locking means (47) at the free end or edge of the lid (4) and said side wall (10) has an opposing, front side wall (43) foldable in a direction outwards or forwards to a position, in which it is in the same plane as the bottom (13) of the tray (3), characterized in that the front side wall (43) is extended from its upper score line (44) to form the lid (4), said flap is intended to lie flat against the back side wall (10) and being fixed in this position by the locking means (47) in the closed condition of the lid.

12. A package as claimed in claim 1, characterized in that said edge flap (20) is connected to said wall (16) along a score line (28) which is interrupted by a slit (29) at least in one zone, the ends of said slit joining the score line (28) a distance in on the side wall (16) to form a locking tongue (30) intended to form a locking projection directed outwardly in the plane of the edge flaps.

* * * * *